US012110578B2

(12) United States Patent
Jang et al.

(10) Patent No.: US 12,110,578 B2
(45) **Date of Patent: *Oct. 8, 2024**

(54) AUSTENITIC STAINLESS STEEL HAVING A LARGE AMOUNT OF UNIFROMLY DISTRIBUTED NANOMETER-SIZED PRECIPITATES AND PREPARING METHOD OF THE SAME

(71) Applicant: KOREA ADVANCED INSTITUTE OF SCIENCE AND TECHNOLOGY, Daejeon (KR)

(72) Inventors: Changheui Jang, Daejeon (KR); Jiho Shin, Daejeon (KR); Byeong Seo Kong, Daejeon (KR); Hyeon Bae Lee, Daejeon (KR); Chaewon Jeong, Daejeon (KR); Hyun Woo Koo, Daejeon (KR)

(73) Assignee: KOREA ADVANCED INSTITUTE OF SCIENCE AND TECHNOLOGY, Daejeon (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/045,267

(22) PCT Filed: Dec. 6, 2019

(86) PCT No.: PCT/KR2019/017159
§ 371 (c)(1),
(2) Date: Oct. 5, 2020

(87) PCT Pub. No.: WO2021/100959
PCT Pub. Date: May 27, 2021

(65) Prior Publication Data

US 2023/0117314 A1 Apr. 20, 2023

(30) Foreign Application Priority Data

Nov. 18, 2019 (KR) ..... 10-2019-0147897

(51) Int. Cl.
*C22C 38/58* (2006.01)
*C21D 8/02* (2006.01)
*C22C 38/48* (2006.01)

(52) U.S. Cl.
CPC ..... *C22C 38/58* (2013.01); *C21D 8/0226* (2013.01); *C22C 38/48* (2013.01); *C21D 2211/001* (2013.01)

(58) Field of Classification Search
CPC ..... C22C 38/58
See application file for complete search history.

(56) References Cited

U.S. PATENT DOCUMENTS

2002/0110476 A1 8/2002 Maziasz et al.
2003/0056860 A1* 3/2003 Maziasz ..... C22C 38/04 420/48
2008/0163957 A1 7/2008 Brady et al.

FOREIGN PATENT DOCUMENTS

CN 101501233 8/2009
CN 105452505 3/2016
(Continued)

OTHER PUBLICATIONS

Maziasz, P., Shingledecker, J. and Pollard, M. (2010). CF8C-Plus: A New Cast Stainless Steel for High-Temperature Diesel Exhaust Components. [online] Available at: https://www1.eere.energy.gov/vehiclesandfuels/pdfs/deer_2007/session9/deer07_maziasz.pdf [Accessed Apr. 5, 2024]. (Year: 2010).*
(Continued)

*Primary Examiner* — Jophy S. Koshy
(74) *Attorney, Agent, or Firm* — LEX IP MEISTER, PLLC

(57) ABSTRACT

Austenitic stainless steel includes 16 to 26 wt % of chromium (Cr), 8 to 22 wt % of nickel (Ni), 0.02 to 0.1 wt % of carbon (C), 0.2 to 1 wt % of niobium (Nb), and 2 to 3.5 wt % of manganese (Mn), and has an austenite matrix, wherein
(Continued)

a nanosized niobium carbide (NbC) is precipitated in the austenite matrix, and the nanosized niobium carbide is uniformly dispersed in the austenite matrix. The austenitic stainless steel may further include 0.5 to 1.5 wt % of molybdenum (Mo).

10 Claims, 13 Drawing Sheets

(56) References Cited

FOREIGN PATENT DOCUMENTS

| | | |
|---|---|---|
| CN | 106244945 | 12/2016 |
| CN | 107283086 | 10/2017 |
| CN | 109504833 | 3/2019 |
| CN | 110499455 | 11/2019 |
| JP | S63199851 | 8/1988 |
| JP | H0297648 | 4/1990 |
| JP | H0297649 | 4/1990 |
| JP | H1088289 | 4/1998 |
| JP | 3764586 | 4/2006 |
| JP | 2007-070696 | 3/2007 |
| JP | 2016-183412 | 10/2016 |
| KR | 10-2003-0049814 | 6/2003 |
| KR | 10-0570894 | 4/2006 |
| KR | 10-0856659 | 9/2008 |
| KR | 10-1401625 | 6/2014 |
| KR | 10-2016-0018748 | 2/2016 |
| KR | 10-2017-0074265 | 6/2017 |
| KR | 10-1943591 | 1/2019 |
| KR | 10-1974815 | 5/2019 |
| WO | 2009-101285 | 8/2009 |

OTHER PUBLICATIONS

KIPO, PCT Search Report & Written Opinion of PCT/KR2019/017159 dated Aug. 7, 2020.

* cited by examiner

AUSTENITIC STAINLESS STEEL HAVING A LARGE AMOUNT OF UNIFROMLY DISTRIBUTED NANOMETER-SIZED PRECIPITATES AND PREPARING METHOD OF THE SAME

TECHNICAL FIELD

Austenitic stainless steel with a large amount of uniformly distributed nanosized precipitates, and a manufacturing method thereof, are provided.

BACKGROUND ART

Conventionally, austenitic stainless steel is widely used in modern industries such as construction or architecture because of merits such as excellent corrosion resistance, mechanical properties, and workability.

Recently, structural materials used in the energy industry have been exposed to a substantially high driving temperature region for high heat efficiency. However, the use of the austenitic stainless steel is limited because it is difficult to acquire integrity of materials at a high temperature. Particularly, when the austenitic stainless steel is used in structural materials for nuclear reactors exposed to a high-energy neutron environment, integrity of the materials may be degrade because of void swelling caused by long-term operation of nuclear reactors.

Therefore, to improve a general high temperature property and irradiation resistance of the austenitic stainless steel, researches on of dispersing the fine precipitates in the austenite matrix are in progress.

For example, the researches include cooling and stabilization heat treatment process performed after a solution annealing process through high temperature heat treatment, a diffusion reaction process using a nitriding and carburizing method, and a mechanical alloying process.

However, when it is attempted to apply the conventional processes to the austenitic stainless steel and form the fine precipitates, an excessively long time may be needed and an expensive processing method must be used, so the manufacturing cost may increase. Particularly, the processes in present use have limits in having a high density in the matrix and forming uniformly distributed nanosized precipitates.

In another way, according to Korean Patent No. 1,943,591 invented by the inventors of the present application, the austenitic stainless steel containing niobium includes 16-26 wt % of chromium (Cr), 8-22 wt % of nickel (Ni), 0.02-0.1 wt % of carbon (C), 0.2-1 wt % of niobium (Nb), 0.015-0.025 wt % of titanium (Ti), 0.004-0.01 wt % of nitrogen (N), and 0.5-2 wt % of manganese (Mn), having an austenite matrix, and includes equal to or less than 11 nm of a nanosized niobium carbide (NbC) with an average density of $1\times10^{22}$ #/m$^3$ in the austenite matrix.

However, according to Korean Patent No. 1,943,591, even when the nanosized precipitates that are fine and have a high density may be formed in the austenite matrix, it is needed to distribute the nanosized precipitates that are finer in size and have a higher density in the austenite matrix so as to further improve high temperature strength, irradiation resistance, and creep resistance.

Preceding literatures are: Korean Patent No. 1,943,591, Korean Published Patent No. 2017-0074265, Korean Patent No. 1,401,625, and Japan Patent No. 3,764,586.

DISCLOSURE

The present invention has been made in an effort to provide austenitic stainless steel and a manufacturing method thereof for containing high number density of nanosized precipitates that are uniformly distributed in an austenite matrix.

The present invention has been made in another effort to provide austenitic stainless steel and a manufacturing method thereof for uniformly distributing a large amount of nanosized niobium carbides (NbC) or niobium-molybdenum carbides ((Nb,Mo)C) in a matrix of austenite stainless steel.

The present invention has been made in another effort to provide austenitic stainless steel and a manufacturing method thereof for improving mechanical characteristics including high-temperature strength of austenitic stainless steel.

The present invention has been made in another effort to provide austenitic stainless steel and a manufacturing method thereof for improving irradiation resistance of austenitic stainless steel to neutrons.

The present invention has been made in another effort to provide austenitic stainless steel and a manufacturing method thereof for improving creep resistance of austenitic stainless steel.

The present invention has been made in another effort to provide austenitic stainless steel and a manufacturing method thereof for reducing a production cost of austenitic stainless steel.

The present invention has been made in another effort to provide austenitic stainless steel and a manufacturing method thereof for improving productivity of austenitic stainless steel.

An exemplary embodiment of the present invention may be used to achieve objects which are not specifically mentioned other than the above-mentioned object.

An exemplary embodiment of the present invention provides austenitic stainless steel including 16 to 26 wt % of chromium (Cr), 8 to 22 wt % of nickel (Ni), 0.02 to 0.1 wt % of carbon (C), 0.2 to 1 wt % of niobium (Nb), and 2 to 3.5 wt % of manganese (Mn), and includes an austenite matrix, wherein a nanosized niobium carbide (NbC) is precipitated in the austenite matrix, and the niobium carbide is uniformly dispersed in the austenite matrix.

The austenitic stainless steel may further include 0.5 to 1.5 wt % of molybdenum (Mo).

A nanosized niobium-molybdenum carbide may be precipitated in the austenite matrix, and the niobium-molybdenum carbide may be uniformly dispersed in the austenite matrix.

The austenitic stainless steel may further include greater than 0 wt % and equal to or less than 0.3 wt % of silicon (Si).

An average size of the nanosized niobium carbide may be equal to or less than 11 nm.

A number density of the niobium carbide may be $1\times10^{14}$-$5\times10^{15}$ #/m$^2$ in the austenite matrix.

A density of the niobium carbide may be $1\times10^{22}$-$1\times10^{23}$ #/m$^3$ in the austenite matrix.

An average size of the nanosized niobium-molybdenum carbide may be equal to or less than 6 nm.

A number density of the niobium-molybdenum carbide may be $5\times10^{14}$-$5\times10^{15}$ #/m$^2$ in the austenite matrix.

A density of the niobium-molybdenum carbide may be $1\times10^{22}$-$5\times10^{23}$ #/m$^3$ in the austenite matrix.

The austenitic stainless steel may further include greater than 0 wt % and equal to or less than 0.01 wt % of phosphorus (P) and greater than 0 wt % and equal to or less than 0.01 wt % of sulfur (S).

Another embodiment of the present invention provides a method for manufacturing austenitic stainless steel including: melting mixed steel including 16 of 26 wt % of chromium (Cr), 8 of 22 wt % of nickel (Ni), 0.02 to 0.1 wt % of carbon (C), 0.2 to 1 wt % of niobium (Nb), and 2 to 3.5 wt % of manganese (Mn), and casting the melted mixed steel, and forming cast steel with an austenite matrix to thus perform melting and casting; deducing a non-recrystallization temperature by evaluating a high temperature deformation behavior of the cast steel; applying a homogenizing heat treatment to the cast steel; performing hot rolling of equal to or greater than one pass at a temperature that is higher than the non-recrystallization temperature, and performing hot rolling of equal to or greater than one pass at a temperature that is lower than the non-recrystallization temperature to thus perform multi-pass hot rolling; and precipitating a nanosized niobium carbide in the austenite matrix by heat treating the hot rolled cast steel and air cooling the same, wherein the nanosized niobium carbide is uniformly dispersed in the austenite matrix.

The mixed steel may further include 0.5 to 1.5 wt % of molybdenum (Mo).

A nanosized niobium-molybdenum carbide may be precipitated in the austenite matrix by heat treating the hot rolled cast steel and air cooling the same, and the nanosized niobium-molybdenum carbide may be uniformly dispersed in the austenite matrix.

The mixed steel may further include greater than 0 wt % and equal to or less than 0.3 wt % of silicon (Si).

The multi-pass hot rolling may include performing hot rolling of 5 to 15 passes.

Hot rolling of 3 to 10 passes may be performed at a temperature that is higher than the non-recrystallization temperature, and hot rolling of 2 to 5 passes may be performed at a temperature that is lower than the non-recrystallization temperature.

While the hot rolling of respective passes is sequentially performed, performance temperatures of the respective passes may be lowered by 10 to 50° C.

In the applying of a homogenizing heat treatment to the cast steel, a heat treatment may be progressed for 30 minutes to 2 hours at a temperature of 1200 to 1300° C.

When the hot rolled cast steel is heat treated, a heat treatment may be progressed for 1 to 4 hours at a temperature of 700 to 800° C.

The austenitic stainless steel according to the Example, and the manufacturing method thereof may contain nanosized precipitates having a high number density and uniformly distributed in the austenite matrix, may uniformly distribute a large amount of nanosized niobium carbides or niobium-molybdenum carbides in the matrix in the austenitic stainless steel, may improve mechanical characteristics such as high temperature strength of the austenitic stainless steel, may improve irradiation resistance on the neutrons, may improve creep resistance, may reduce the production cost of the austenitic stainless steel, and may improve productivity.

MODE FOR INVENTION

Figure 1:
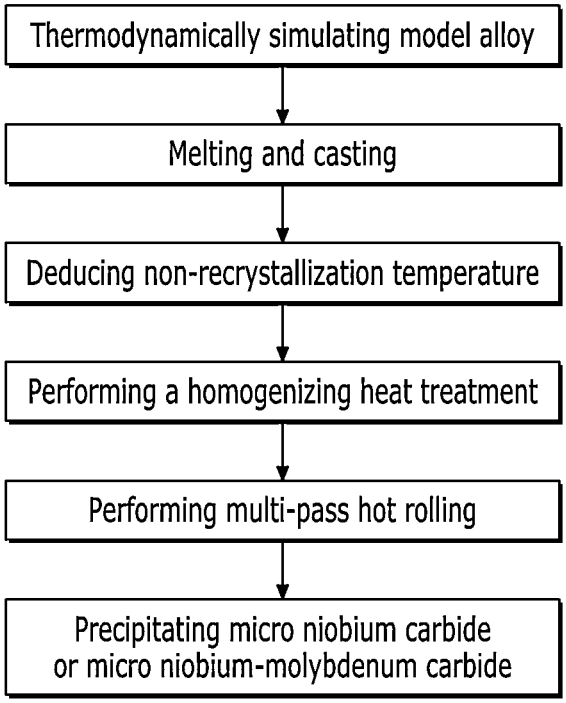
FIG. 1 shows a flowchart of a method for manufacturing austenitic stainless steel according to an example.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention. The drawings and description are to be regarded as illustrative in nature and not restrictive, and like reference numerals designate like elements throughout the specification. Further, a detailed description of a well-known related art will be omitted.

Unless explicitly described to the contrary, the word "comprise" and variations such as "comprises" or "comprising" will be understood to imply the inclusion of stated elements but not the exclusion of any other elements.

The austenitic stainless steel according to exemplary embodiments includes about 16 to 26 wt % of chromium (Cr), about 8 to 22 wt % of nickel (Ni), about 0.02 to 0.1 wt % of carbon (C), about 0.2 to 1 wt % of niobium (Nb), and about 2 to 3.5 wt % of manganese (Mn).

The austenitic stainless steel may have an austenite matrix.

The austenitic stainless steel may contain uniformly distributed Nanosized precipitates with a high number of density in the matrix.

The austenitic stainless steel includes 16 to 26 wt % of chromium (Cr).

The chromium is a ferrite stabilizing element and is essentially used for a stainless steel material that is usable in a high temperature and high pressure condition simultaneously requiring excellent oxidation and corrosion resistance, and creep strength.

When less than about 16 wt % of chromium is included in the austenitic stainless steel, oxidation resistance and corrosion resistance of the stainless steel may be deteriorated, and when greater than about 26 wt % thereof is included, a delta ferrite structure is formed to thereby form an abnormal structure with an austenitic structure, so strength and toughness of the stainless steel may be deteriorated. Further, stability of the austenite phase at a high temperature is deteriorated, thereby deteriorating creep strength.

The austenitic stainless steel includes about 8 to 22 wt % of nickel (Ni).

The nickel may enhance corrosion resistance of the austenitic stainless steel in a non-oxidizing environment, and may increase stacking fault energy to have resistance to stress corrosion cracking. The nickel is an essential element for acquiring a stabilized austenite structure, and is an essential element for obtaining desired creep strength by acquiring structure stability in the case of a long-time use. To have a single crystal structure, a content of nickel may be determined by a thermodynamic calculation on the content of chromium, iron, and nickel, and for example, nickel may be controlled within a range of about 8 to 22 wt %.

The austenitic stainless steel includes about 0.02 to 0.1 wt % of carbon (C).

The carbon is an element that has an effect of stabilizing the austenite phase, and the carbon may increase strength of the stainless steel by producing precipitates in combination of oversaturated carbon and elements such as chromium, niobium, or titanium during a heat treatment process or a cooling process. Therefore, in the viewpoint of obtaining high temperature strength, it is preferable to contain an amount of carbon that is appropriate to the amount of a carbide forming element, considering a point of reinforcement according to precipitation of the carbide in the crystal grain. Further, the carbon may improve characteristics of the stainless steel such as room temperature strength, high temperature strength, welding property, or formability.

When the content of carbon is less than about 0.02 wt % in the austenitic stainless steel, the mechanical strength characteristic of the stainless steel at the room temperature may be deteriorated, and when the content of carbon is greater than about 0.1 wt %, the welding property and formability of the stainless steel may be worsened, and the toughness of the stainless steel may be deteriorated.

The austenitic stainless steel includes about 2 to 3.5 wt % of manganese (Mn).

The manganese may support deoxidation at the time of manufacturing, may stabilize the austenite matrix, and may have solid solution strengthening performance. In addition, the manganese increases solubility of N to indirectly support strength. Particularly, the manganese controls a niobium diffusivity in the austenite matrix to hinder precipitates from being coarsened.

When the content of manganese is less than about 2 wt % in the austenitic stainless steel, it may not give a substantial influence to manufacturing nanosized precipitates, and strength of the stainless steel may be lowered, and when the content of manganese is greater than about 3.5 wt %, it may encourage precipitation of intermetallic precipitates such as a sigma phase and may cause deterioration of toughness and flexibility caused by deterioration of structure stability in a high temperature condition. Further, it become fumes at the time of welding, and is attached to a welding portion, and the welding property of the stainless steel caused by this may be deteriorated.

The austenitic stainless steel includes about 0.2 to 1 wt % of niobium (Nb).

The niobium element may be combined to the carbon to form a nanosized niobium carbide, and the nanosized niobium carbide may be uniformly dispersed in the austenite. The nanosized niobium carbide uniformly dispersed in the austenite matrix may significantly improve the mechanical characteristic such as strength of the stainless steel, may improve neutron irradiation resistance, and may improve creep resistance.

When less than about 0.2 wt % of niobium is included in the austenitic stainless steel, the amount of the precipitated niobium carbide or the niobium-molybdenum carbide may be small, so an improvement degree of the mechanical characteristic or the irradiation resistance of the stainless steel may be slight, and when the niobium is included at greater than about 1 wt %, a niobium carbide or a niobium-molybdenum carbide with a coarse particle size may be formed to deteriorate strength and toughness of the stainless steel.

The austenitic stainless steel may further include about 0.5 to 1.5 wt % of molybdenum (Mo).

The molybdenum is an element provided in the matrix to support improvement of high temperature strength, and specifically, improvement of creep strength at the high temperature. Particularly, by molybdenum forming niobium-molybdenum carbide with the added Nb, it may not only reduce a unit lattice length difference with the matrix compared to the Nb carbide, but also hinder the coarsening of the precipitates because of a relatively slow diffusivity of the molybdenum elements between the austenite matrix and the precipitates, while increasing the density and obtain the precipitate stability in the high temperature condition.

When the content of molybdenum is less than about 0.5 wt % in the austenitic stainless steel, it may not influence the refinement of the precipitates, and stability may not be obtained, and when the content of molybdenum is greater than about 1.5 wt %, the austenite structure may become unstable and the creep strength may be deteriorated. Further, containment of a large amount of molybdenum increases the expense.

The niobium element may be combined with the above-noted carbon and the molybdenum to form a nanosized niobium-molybdenum carbide, and the niobium-molybdenum carbide may be uniformly dispersed in the austenite. The nanosized niobium-molybdenum carbide uniformly dispersed in the austenite matrix may significantly improve the mechanical characteristics such as strength of the stainless steel, neutron irradiation resistance, and creep resistance.

An average size of the nanosized niobium carbide or the niobium-molybdenum carbide may be equal to or less than about 11 nm or about 6 nm. Further, in the austenite matrix, the number density of the nanosized niobium carbide or the niobium-molybdenum carbide may be about $1\times10^{14}$-$5\times10^{15}$ #/m$^2$ or $5\times10^{14}$-$5\times10^{15}$ #/m$^2$, and the density of the nanosized niobium carbide or the niobium-molybdenum carbide may be about $1\times10^{22}$-$1\times10^{23}$ #/m$^3$ or $1\times10^{22}$-$5\times10^{23}$ #/m$^3$. Within the above-noted range, the mechanical characteristic of the stainless steel, neutron irradiation resistance, and creep resistance may be further improved.

The austenitic stainless steel may include greater than 0 wt % and equal to or less than about 0.3 wt % of silicon (Si).

The silicon may perform a deoxidation, and may increase an amount of precipitated carbide. Since the silicon may condense the precipitates and coarsen them, so the content of the silicon of the stainless steel may be equal to or less than 0.3 wt % so as to generate nanosized precipitates.

The austenitic stainless steel may include greater than 0 wt % and equal to or less than about 0.01 wt % of phosphorus (P) and greater than 0 wt % and equal to or less than about 0.01 wt % of sulfur (S).

The phosphorus and the sulfur are impurities that inevitably exist in the stainless steel, and when the content of the phosphorus and the sulfur is large a, they may be segregated on a grain boundary, which causes intergranular embrittlement and deteriorates a characteristic such as toughness, so the contents of the phosphorus and the sulfur may be limited to be equal to or less than about 0.01 wt % and about 0.01 wt %, respectively.

Hereinafter, a method for manufacturing austenitic stainless steel according to an example will be described with reference to drawings.

Constitutional elements and contents of stainless steel have been described and will be omitted hereinafter.

Figure 2:
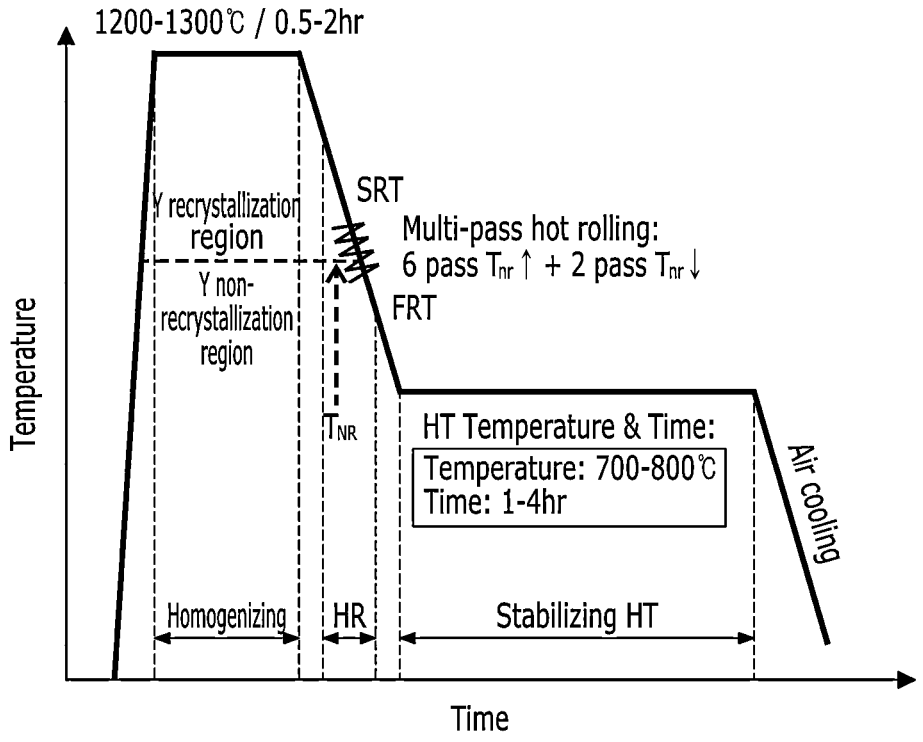
FIG. 2 shows a process for manufacturing austenitic stainless steel and conditions according to an example.

FIG. 1 shows a flowchart of a method for manufacturing austenitic stainless steel according to an example, and FIG. 2 shows a process for manufacturing austenitic stainless steel and conditions according to an example.

Referring to FIG. 1 and FIG. 2, the method for manufacturing austenitic stainless steel includes: thermodynamically simulating a model alloy, melting and casting, deducing a non-recrystallization temperature, performing a homogenizing heat treatment, performing multi-pass hot rolling, and precipitating a nanosized niobium carbide or a micro niobium-molybdenum carbide.

First, a model alloy is thermodynamically simulated, and the melting and casting are performed.

In the melting and casting, a mixed steel including 16 to 26 wt % of chromium (Cr), 8 to 22 wt % of nickel (Ni), 0.02 to 0.1 wt % of carbon (C), 0.2 to 1 wt % of niobium (Nb), and 2 to 3.5 wt % of manganese (Mn) is melted, and the melted mixed steel is cast to form cast steel with an austenite matrix.

Here, the mixed steel may further include about 0.5 to 1.5 wt % of molybdenum (Mo). The mixed steel may further include greater than 0 wt % and equal to or less than 0.3 wt % of silicon (Si). The mixed steel may further include greater than 0 wt % and equal to or less than 0.01 wt % of phosphorus (P), greater than 0 wt % and equal to or less than 0.01 wt % of sulfur (S), remaining iron (Fe), and inevitable impurities.

Known process may be applied to the melting process. For example, a vacuum induction melting process may be applied, and the melting process is not specifically limited thereto.

Known process may be applied to the casting process. For example, it may be cast in an ingot form, and is not specifically limited thereto.

In the melting and casting, the austenite matrix may be formed.

Next, a high temperature deformation behavior of the cast steel formed in the melting and casting is estimated to deduce a non-recrystallization temperature ($T_{NR}$).

A high temperature deformation behavior of the cast steel may be estimated through a hot torsion test or a dynamic material test. For example, to estimate the high temperature deformation behavior of the cast steel, a Gleeble dynamic thermal-mechanical testing may be used, and a non-recrystallization temperature may be deduced through a Gleeble compression test. The Gleeble compression test method is disclosed in the published transaction (e.g., C. N. Homsher, "Determination of the Non-Recrystallization Temperature ($T_{NR}$) in Multiple Microalloyed Steels," Colorado School of Mines, 2012).

The homogenizing heat treatment is performed.

Through the homogenizing heat treatment, the dendritic and not-intended carbide of the cast steel may be dissolved into the matrix, and an austenite single phase is formed in the corresponding heat treatment temperature region, so the subsequent multi-pass hot rolling process may be efficiently performed. By this, nanosized precipitates may be distributed finely and homogeneously in the matrix in the process for precipitating a nanosized niobium carbide or a niobium-molybdenum carbide.

In this process, the cast steel may be homogenizing heat treated for 30 minutes to 2 hours in the temperature range of about 1200 to 1300° C.

When the heat treatment is performed at less than about 1200° C., dissolution of the dendrite and carbonitride precipitate is not sufficiently generated, which may be disadvantageous in homogenizing the alloying element, and when the heat treatment is performed at greater than about 1300° C., not only a production cost may increase, but also the austenite matrix may be partly melted, and microstructural homogenization of the austenite matrix may be not guaranteed accordingly.

When the heat treatment is progressed for less than about 30 minutes, dissolution of the dendritic and unintended carbide may not be sufficiently performed, and solute atoms may be insufficiently diffused. When the heat treatment time is greater than about 2 hours, crystal grains may be coarsened, and the production cost may increase.

When the heat treatment temperature increases in the temperature range and the time range of the above-described homogenizing heat treatment, the corresponding heat treatment time may reduce, and when the heat treatment temperature lowers, the corresponding heat treatment time may increase.

Next, the homogenizing heat treated cast steel may be cooled in the air or water, and multi-pass hot rolling may be performed at the designed hot rolling start temperature.

The multi-pass hot rolling includes, with respect to the deduced non-recrystallization temperature, performing hot rolling of one or more passes at the higher temperature than the non-recrystallization temperature, and performing hot rolling of one or more passes at the lower temperature than the non-recrystallization temperature. Here, the multi-pass hot rolling may signify dividing the hot rolling into a number of sections and performing them stepwise, and the respective sections may be defined as passes.

For example, hot rolling of 5 to 15 passes may be performed in total. In detail, hot rolling of 3 to 10 passes is performed at the higher temperature than the non-recrystallization temperature, and hot rolling of 2 to 5 passes is performed at the lower temperature than the non-recrystallization temperature.

The hot rolling process from among the conventional process for manufacturing austenitic stainless steel containing niobium is performed at the higher temperature than the non-recrystallization temperature.

On the contrary, in the case of the method for manufacturing austenitic stainless steel according to examples, the hot rolling is progressed at the higher temperature than the non-recrystallization temperature, and the hot rolling is progressed at the lower temperature than the non-recrystallization temperature.

The temperatures for executing the respective passes may be different by about 10 to 50° C. For example, when the hot rolling is performed with a number of passes, the hot rolling for each pass is sequentially performed, and the performance temperature of each pass may be lowered by 10 to 50° C. In detail, when the hot rolling of 5 passes is performed, the first pass hot rolling is performed at a hot rolling start temperature that is relatively the highest and is higher than the non-recrystallization temperature, the second pass hot rolling is performed at the temperature that is lower than the first pass hot rolling temperature by about 10-50° C., the third pass hot rolling is performed at the temperature that is lower than the second pass hot rolling temperature by about 10 to 50° C., the fourth pass hot rolling is performed at the temperature that is lower than the third pass hot rolling temperature by about 10 to 50° C. and is lower than the non-recrystallization temperature, and the fifth pass hot rolling may be performed at the hot rolling finishing temperature that is lower than the fourth pass hot rolling by about 10 to 50° C.

It is shown in FIG. 2 that the hot rolling of 6 passes is performed at the temperature that is higher than the non-recrystallization temperature, and the hot rolling of 2 passes is performed at the temperature that is lower than the non-recrystallization temperature, which represents the multi-pass hot rolling.

Dislocations in the matrix may be appropriately distributed by such the stepwise multi-pass hot rolling, and the nanosized niobium carbide or the niobium-molybdenum carbide may be further finely and uniformly dispersed.

A reduction rate of the cast steel caused by performance of the multi-pass hot rolling may be designed if needed, and a thickness may be accordingly controlled.

The nanosized niobium carbide (NbC) or the niobium-molybdenum ((Nb,Mo)C) is precipitated in the austenite matrix.

This represents applying a stabilizing heat treatment to the steel having undergone the multi-pass hot rolling for one to four hours at about 700 to 800° C. and air cooling the same, while the nanosized niobium carbide or the niobium-molybdenum carbide is precipitated, and the nanosized niobium carbide or the niobium-molybdenum carbide is uniformly distributed in the matrix.

When the stabilizing heat treatment temperature is less than about 700° C., the amount of precipitates of the niobium carbide or the niobium-molybdenum carbide may be very small. Further, when the stabilizing heat treatment temperature is greater than about 800° C., a cell structure is formed by a movement of the dislocations in the matrix, and in this instance, the niobium carbide or the niobium-molybdenum carbide is not homogeneously distributed in the matrix but is precipitated along a boundary of the cell structure, so toughness of the stainless steel may be weakened and it may be damaged.

In the case of the conventional method for manufacturing stainless steel including a niobium carbide, a stabilizing heat treatment is performed at about a relatively high 900° C. temperature, which causes coarsening and non-homogenizing distribution of precipitates, but according to the method for manufacturing stainless steel according to exemplary embodiments, the stabilizing heat treatment is performed at about 700 to 800° C. that is an appropriate temperature for forming a niobium carbide, so the nanosized niobium carbide may be homogeneously and uniformly precipitated and distributed in the austenite matrix.

When the stabilizing heat treatment time is less than about an hour, the amount of precipitates of the niobium carbide may be very small, and when it is greater than about 4 hours, the niobium carbide may be coarsened and a carbide of $M_{23}C_6$ formed in the niobium depletion region may reduce corrosion resistance of the stainless steel. In this instance, M may include an element such as chromium or iron.

After the stabilizing heat treatment is performed, the steel is cooled not by water cooling or quenching but by air cooling so as to form a nanosized niobium carbide or niobium-molybdenum carbide nucleus on the matrix by utilizing a solubility difference of elements in the matrix according to the temperature, so the austenitic stainless steel containing nanosized precipitates having a high number density and that are uniformly distributed in the matrix.

The present invention will be described in detail with an example, but the example given below is an exemplary embodiment of the present invention, and the present invention is not limited to the example.

Example 1 and Example 10

1) Casting

The mixed steel with the composition components expressed in Table 1 is melted/cast by using a vacuum induction melting furnace to form a casting ingot.

Table 1 expresses chemical composition values measured with an ICP-AES analysis method, and units of respective numerical numbers are wt %.

TABLE 1

| | Fe | Cr | Ni | C | Mn | Si | Mo |
|---|---|---|---|---|---|---|---|
| Example 1 | Bal. | 24.03 | 20.88 | 0.035 | 3.41 | 0.21 | — |
| Example 10 | Bal. | 24.12 | 20.94 | 0.034 | 3.44 | 0.21 | 0.77 |

2) Non-Recrystallization Temperature ($T_{NR}$) Setting

To estimate a high-temperature deformation behavior, a Gleeble dynamic thermal-mechanical testing (Gleeble 3800) is used for a high temperature compression test.

Figure 3A:
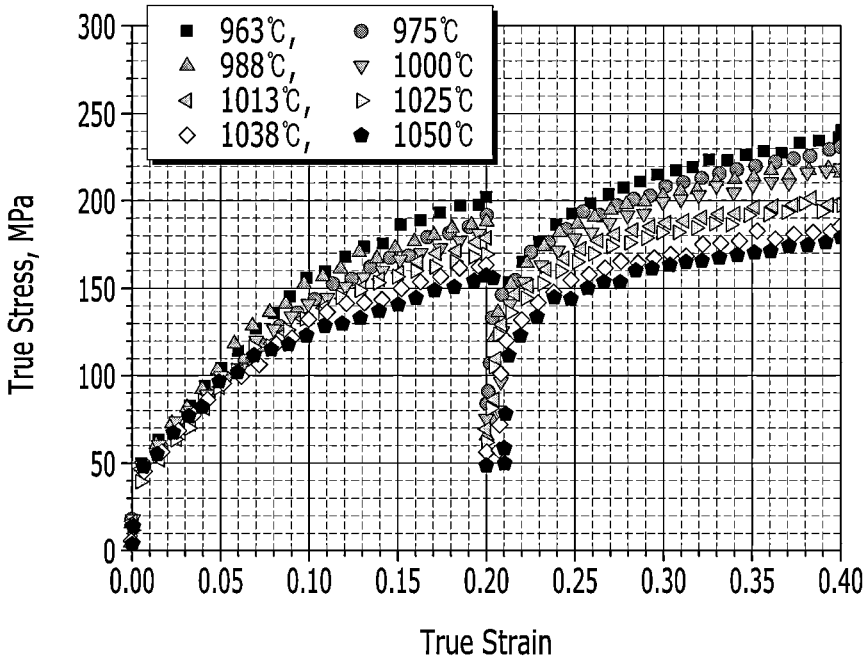
FIG. 3A and FIG. 3B show graphs of a high-pressure compression test result in deducing a non-recrystallization temperature according to an Example 1.
Figure 3B:
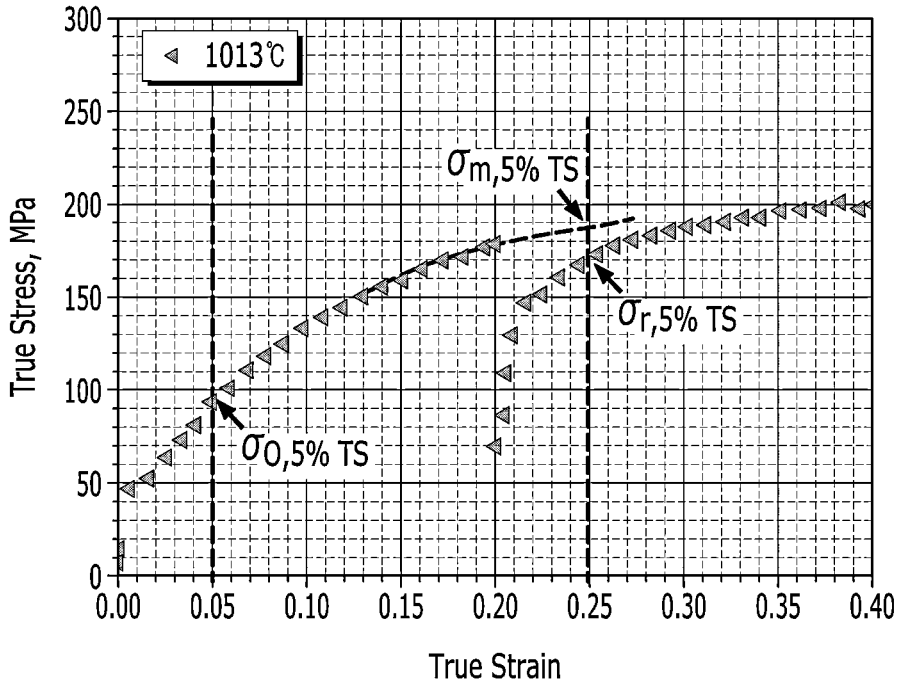

A specimen shape is a cylindrical shape with a diameter of 10 mm and a height of 12 mm, which is a generally used standard in the high temperature compression test. The Gleeble compression test is performed at a deformation speed of 5 $s^{-1}$ at an interval of 12.5° C. from 963° C. to 1050° C., and deduces a high temperature deformation constitutive relation from a true stress-true strain curve line obtained from respective tests. Further, in a high purity argon environment, to prevent oxidation, the temperature of the specimen increases up to 1200° C. at the heating rate of 10° C./s to maintain it for ten minutes, air cool it, perform a compression test twice at the test temperature, and apply deformation by 20% for each compression. A high pressure compression test result is shown in FIG. 3A and FIG. 3B.

The non-recrystallization temperature deduced through the test is 1013° C.

3) Homogenizing Heat Treatment

The cast ingot obtained in 1) undergoes homogenizing heat treatment for an hour at 1300° C.

4) Multi-Pass Hot Rolling

A total of 8 times of multi-pass rolling are performed with respect to the non-recrystallization temperature of 1013° C. obtained in 2), and the corresponding total reduction rate is 70%. The hot rolling start temperature is 1235° C., 6 passes of rolling are performed with the temperature interval of about 40° C. up to the non-recrystallization temperature, and in a like manner, 2 passes of rolling are performed with the temperature interval of about 40° C. below the non-recrystallization temperature.

(Table 2)

5) Nanosized Niobium Carbide or Micro Niobium-Molybdenum Carbide Precipitation

A heat treatment for forming a nanosized niobium carbide (Example 1) or forming a niobium-molybdenum carbide (Example 10) is performed to the steel having undergone 4) for an hour at 700° C., and air cooling is performed thereto to thus manufacture austenitic stainless steel including a nanosized niobium carbide or a niobium-molybdenum carbide.

Example 2 to Example 9

The austenitic stainless steel including a nanosized niobium carbide is manufactured through the same manufacturing process except for performing the heat treatment of 5)

of Example 1 for two hours at 700° C. (Example 2), performing the heat treatment for four hours at 700° C. (Example 3), performing the heat treatment for an hour at 750° C. (Example 4), performing the heat treatment for two hours at 750° C. (Example 5), performing the heat treatment for four hours at 750° C. (Example 6), performing the heat treatment for an hour at 800° C. (Example 7), performing the heat treatment for two hours at 800° C. (Example 8), and performing the heat treatment for four hours at 800° C. (Example 9).

Example 11 to Example 18

The austenitic stainless steel including a nanosized niobium-molybdenum carbide is manufactured through the same manufacturing process except for performing a heat treatment of 5) of Example 2 for two hours at 700° C. (Example 11), performing the heat treatment for four hours at 700° C. (Example 12), performing the heat treatment for an hour at 750° C. (Example 13), performing the heat treatment for two hours at 750° C. (Example 14), performing the heat treatment for four hours at 750° C. (Example 15), performing the heat treatment for an hour at 800° C. (Example 16), performing the heat treatment for two hours at 800° C. (Example 17), and performing the heat treatment for four hours at 800° C. (Example 18).

Comparative Examples 1 to 9

Differed from Example 1 and Example 10, a homogenizing heat treatment is performed for an hour at 1200° C., and hot rolling is progressed with respect to a predetermined non-recrystallization temperature. The hot rolling start temperature is 1120° C., 4 passes of rolling are performed with the temperature interval of about 27° C. up to the non-recrystallization temperature, and in a like manner, 2 passes of rolling are performed with the temperature interval of about 27° C. below the non-recrystallization temperature. The hot rolled steel is heat treated with respect to temperature and time so as to form a nanosized niobium carbide, and air cooling is performed, thereby preparing austenitic stainless steel including a nanosized niobium carbide.

Comparative Examples 1 to 9 that are the austenite steel including a nanosized niobium carbide are stainless steel having a similar chemical composition to Example 1 and Example 10 except for the content of manganese and molybdenum. The quantitatively analyzed chemical composition values are expressed in Table 3.

From among the heat treatment conditions for preparing the austenitic stainless steel including a nanosized niobium carbide, the temperature has the range of 700° C. to 800° C. and the time has the range of one to four hours, which are equivalent condition to the above example.

The austenitic stainless steel including a nanosized niobium carbide is manufactured through the same manufacturing process except for performing a nanosized niobium precipitation heat treatment for an hour at 700° C. (Comparative Example 1), performing the treatment for two hours at 700° C. (Comparative Example 2), performing the treatment for four hours at 700° C. (Comparative Example 3), performing the treatment for an hour at 750° C. (Comparative Example 4), performing the treatment for two hours at 750° C. (Comparative Example 5), performing the treatment for four hours at 750° C. (Comparative Example 6), performing the treatment for an hour at 800° C. (Comparative Example 7), performing the treatment for two hours at 800° C. (Comparative Example 8), and performing the treatment for four hours at 800° C. (Comparative Example 9).

A detailed description on the austenitic stainless steel including a niobium carbide according to a Comparative Example 1 is disclosed in Korean Patent No. 1,943,591 invented by the inventors of the present application.

TABLE 3

| | Fe | Cr | Ni | C | Mn | Si | Nb | Ti | N |
|---|---|---|---|---|---|---|---|---|---|
| Comparative Example 1 | Bal. | 24.13 | 21.07 | 0.042 | 1.32 | 0.23 | 0.27 | 0.023 | 0.008 |

Experimental Example

Figure 4A:
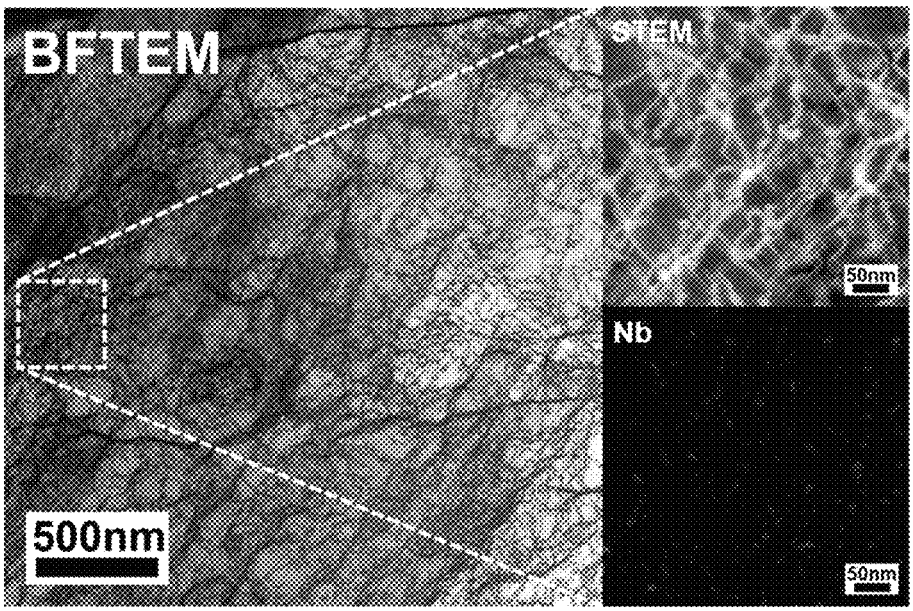
FIG. 4A to FIG. 4C show photographs of a microstructure taken by a transmission electron microscope of austenitic stainless steel including a nanosized niobium carbide according to an Example 5.
Figure 4B:
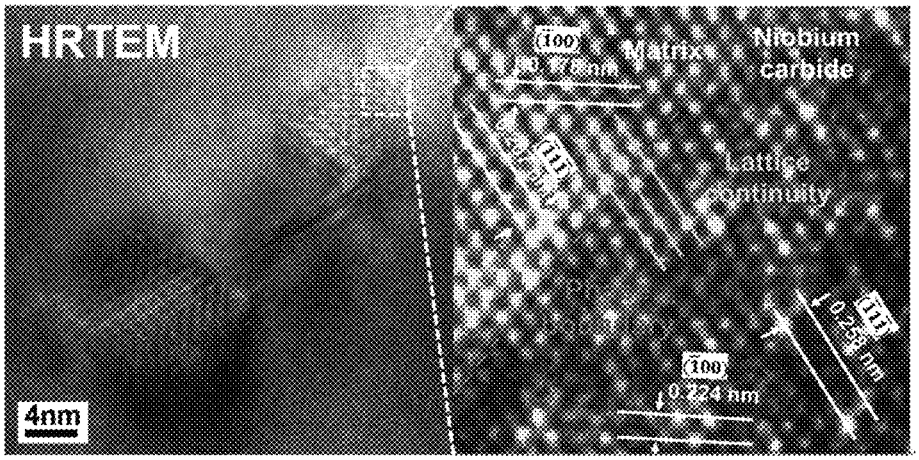
Figure 4C:
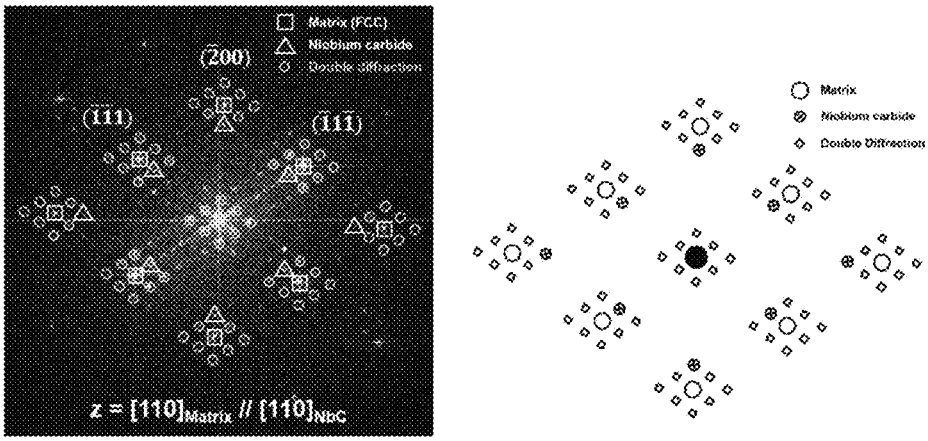
Figure 5A:
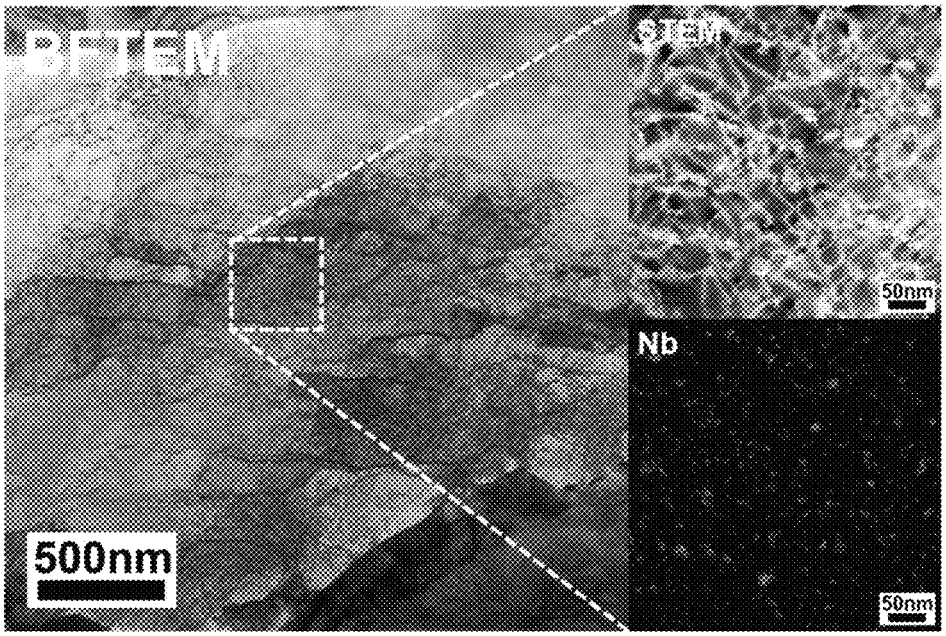
FIG. 5A to FIG. 5C show photographs of a microstructure taken by a transmission electron microscope of austenitic stainless steel including a nanosized niobium-molybdenum carbide according to an Example 15.
Figure 5B:
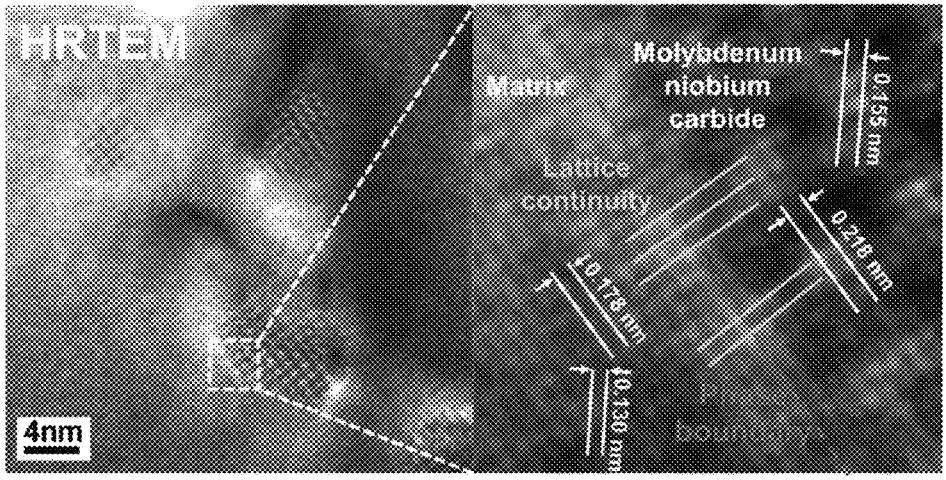
Figure 5C:
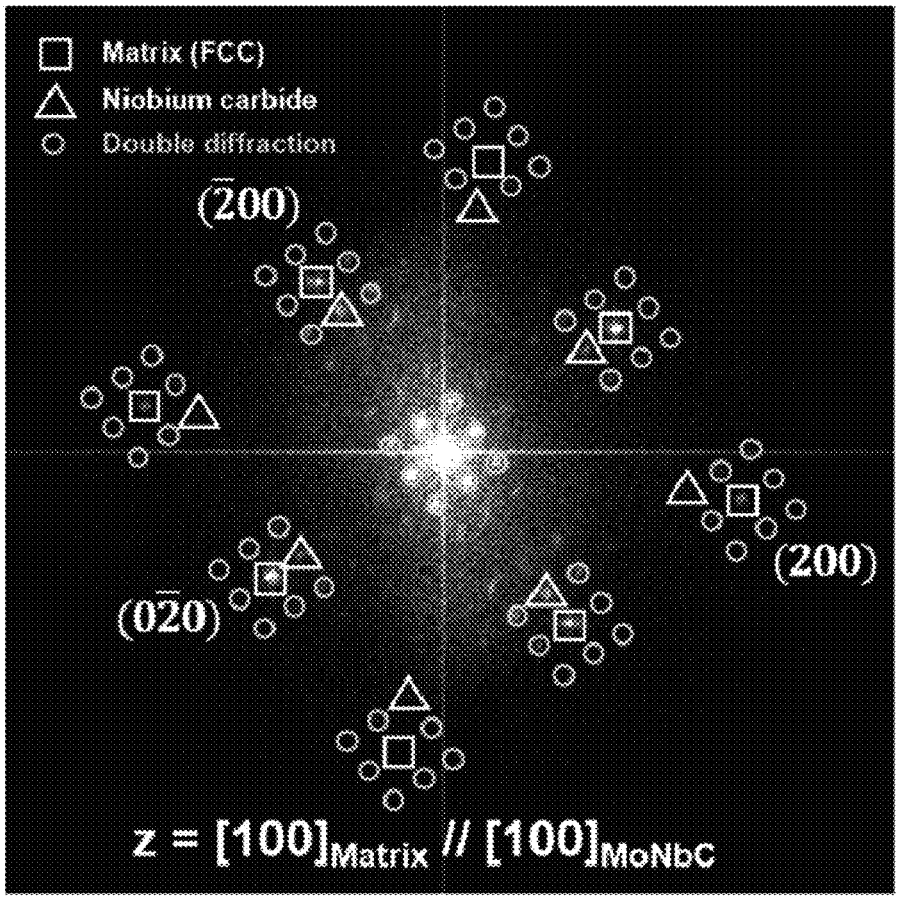
Figure 6:
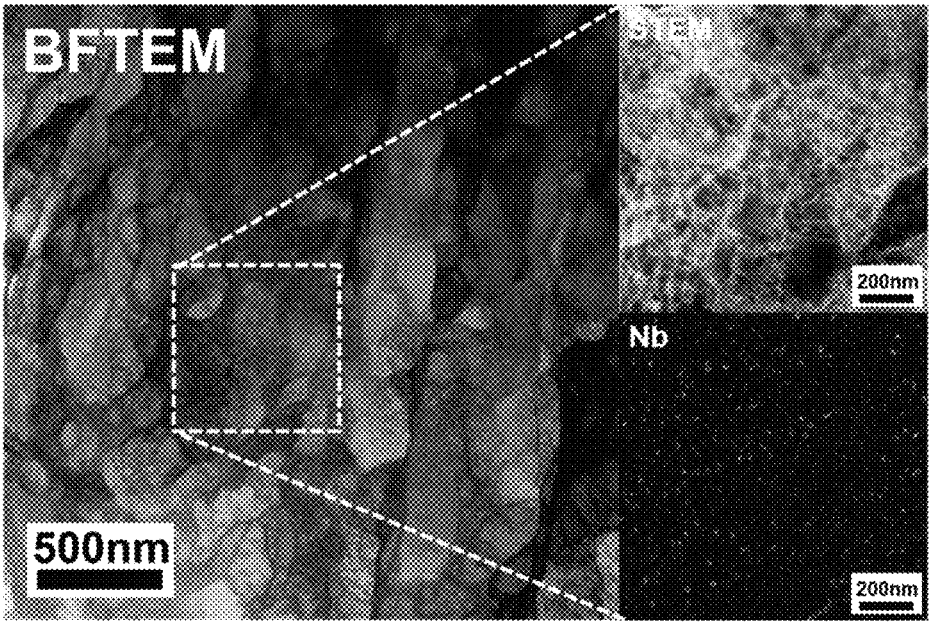
FIG. 6 shows photographs of a microstructure taken by a transmission electron microscope of austenitic stainless steel including a nanosized niobium carbide according to a Comparative Example 8.

FIG. 4A to FIG. 4C show photographs of a microstructure taken by a transmission electron microscope of austenitic stainless steel including a nanosized niobium carbide according to Example 5, FIG. 5A to FIG. 5C show photographs of a microstructure taken by a transmission electron microscope of austenitic stainless steel including a nanosized niobium-molybdenum carbide according to Example 15, and FIG. 6 shows a photograph of a microstructure taken by a transmission electron microscope of austenitic stainless steel including a nanosized niobium carbide according to Comparative Example 8. Further, an average size and a density of the precipitates according to the heat treatment conditions of the austenitic stainless steel including a nanosized niobium carbide or a niobium-molybdenum according to Examples 1 to 18 and Comparative Examples 1 to 9 including Example 5, Example 15, and Comparative Example 8 are measured and corresponding results are shown in FIG. 7A and FIG. 7B.

Referring to FIG. 4A to FIG. 5C and FIG. 7A and FIG. 7B, in the case of the stainless steel according to Examples 5 and 15, they are very homogeneously or uniformly distributed in the matrix. In this instance, a number density, a density, and an average diameter size of the nanosized niobium carbide are respectively $1.67\times10^{15}$ #/m$^2$, $6.87\times10^{22}$ #/m$^3$, and 7.7 nm, and a number density, a density, and an average diameter size of the nanosized niobium-molybdenum carbide are respectively $2.45\times10^{15}$ #/m$^2$, $1.21\times10^{23}$ #/m$^3$, and 5.9 nm.

In another way, in the case of the stainless steel according to Comparative Examples 1 to 9, the niobium carbide is relatively very homogeneously or uniformly distributed in the matrix, but the density of the niobium carbide or the niobium-molybdenum carbide is relatively low. The number density, the density, and the average size of the stainless steel according to Comparative Example 8 are respectively $5.12\times10^{14}$ #/m$^2$, $1.13\times10^{22}$ #/m$^3$, and 9.4 nm.

Figure 7A:
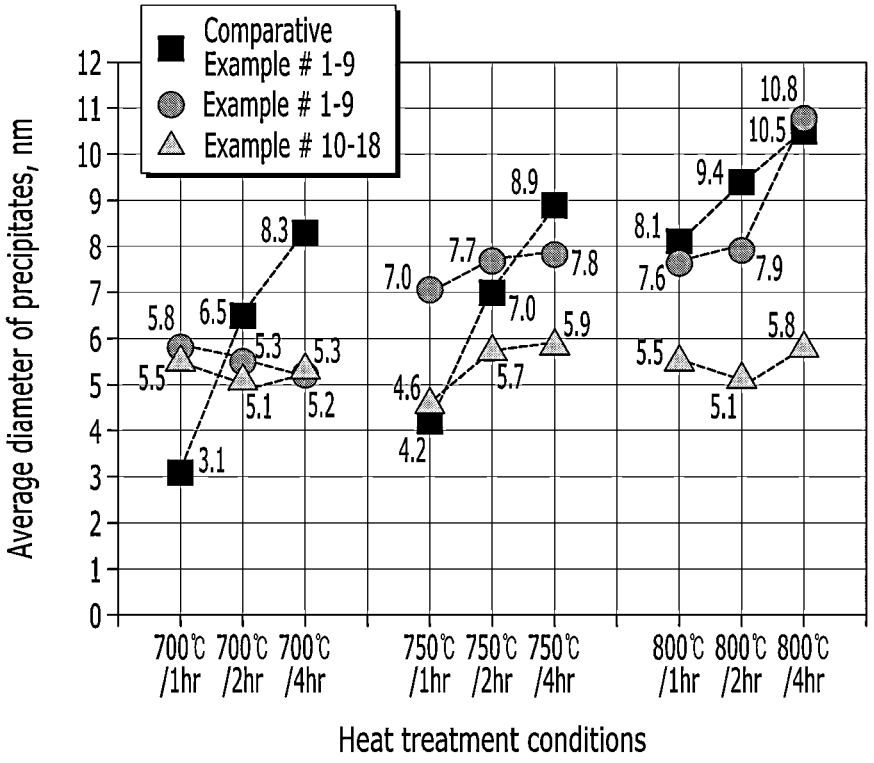
FIG. 7A and FIG. 7B show graphs of results of measuring an average size and a density of precipitates following heat treatment conditions of austenitic stainless steel including a nanosized niobium carbide or a niobium-molybdenum carbide according to Examples 1 to 18 and Comparative Examples 1 to 9.
Figure 7B:
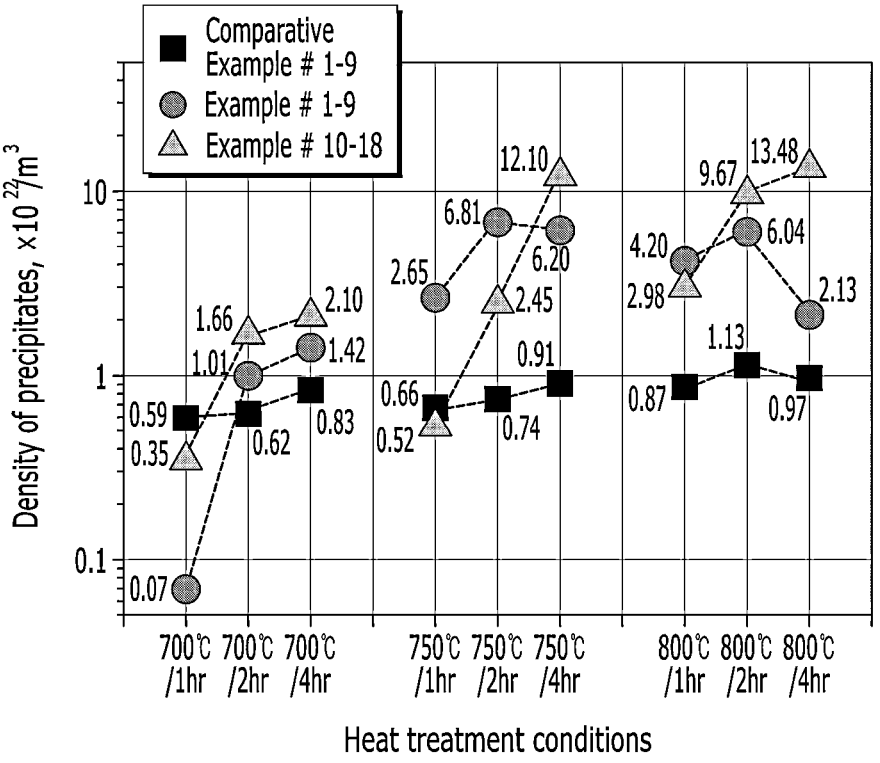

Referring to FIG. 7A and FIG. 7B, an average diameter of nanosized niobium carbide precipitates according to exemplary embodiments may be in the range of 5.2 nm to 10.8 nm, which it may be similar or less than the comparative examples depending on the heat treatment conditions, and the density is in the range of $0.07\times10^{22}$ #/m$^3$ to $13.48\times10^{22}$ #/m$^3$, which is generally higher than in the comparative examples. The average density of the precipitates of the nanosized niobium carbide according to Examples 1 to 9 is increased by about 14 times to the maximum, compared to the comparative examples.

Because comparative Examples 1 to 9 include a relatively small amount of manganese compared to the examples or include no molybdenum elements even when they have similar chemical compositions to exemplary embodiments and undergo the same thermal-mechanical process, se the size of carbides is relatively considered to be coarsened compared to the exemplary embodiments, and in the process for forming carbides in the matrix, the density of carbides is considered to be relatively low compared to the exemplary embodiments.

On the contrary, the austenitic stainless steel according to exemplary embodiments includes a relatively larger amount of manganese or molybdenum elements than the comparative examples, so it encourages the nanosized niobium carbide or the niobium-molybdenum carbide to be homogeneously/uniformly precipitated in the austenite matrix, thereby forming the carbide with relatively greater density and high-temperature stability than the comparative examples. By this, a mechanical behavior of the stainless steel may be more excellent than that of the comparative examples, it may have high strength against specific gravity, irradiation resistance to neutrons may be further greatly improved compared to the comparative examples, and creep resistance may be further improved compared to the comparative examples.

The method for manufacturing austenitic stainless steel may be applied to vanadium, titanium, tantalum, a carbide of hafnium, or a nitride thereof in addition to the niobium carbide when the precipitates are formed at below the melting temperature of the matrix.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

The invention claimed is:

1. Austenitic stainless steel comprising 16 to 26 wt % of chromium (Cr), 8 to 22 wt % of nickel (Ni), 0.02 to 0.1 wt % of carbon (C), 0.2 to 1 wt % of niobium (Nb), and 2 to 3.5 wt % of manganese (Mn), and including an austenite matrix, wherein a niobium carbide (NbC) is precipitated in the austenite matrix, and the niobium carbide is uniformly dispersed in the austenite matrix, wherein an average diameter of the niobium carbide is equal to or less than 11 nm, and wherein the austenitic stainless steel is a forged multi-pass hot rolled stainless steel.

2. The austenitic stainless steel of claim 1, wherein the austenitic stainless steel further includes 0.5 to 1.5 wt % of molybdenum (Mo).

3. The austenitic stainless steel of claim 2, wherein a niobium-molybdenum carbide is precipitated in the austenite matrix, and the niobium-molybdenum carbide is uniformly dispersed in the austenite matrix.

4. The austenitic stainless steel of claim 3, wherein the austenitic stainless steel further includes greater than 0 wt % and equal to or less than 0.3 wt % of silicon (Si).

5. The austenitic stainless steel of claim 3, wherein an average size of the niobium-molybdenum carbide is equal to or less than 6 nm.

6. The austenitic stainless steel of claim 3, wherein a number density of the niobium-molybdenum carbide is $5\times10^{14}$-$5\times10^{15}$ #/m$^2$ in the austenite matrix.

7. The austenitic stainless steel of claim 3, wherein a density of the niobium-molybdenum carbide is $1\times10^{22}$-$5\times10^{23}$ #/m$^3$ in the austenite matrix.

8. The austenitic stainless steel of claim 1, wherein a number density of the niobium carbide is $1\times10^{14}$-$5\times10^{15}$ #/m$^2$ in the austenite matrix.

9. The austenitic stainless steel of claim 1, wherein a density of the niobium carbide is $1\times10^{22}$-$1\times10^{23}$ #/m$^3$ in the austenite matrix.

10. The austenitic stainless steel of claim 1, wherein the austenitic stainless steel further includes greater than 0 wt % and equal to or less than 0.01 wt % of phosphorus (P) and greater than 0 wt % and equal to or less than 0.01 wt % of sulfur (S).

* * * * *